US009080278B2

(12) United States Patent
Chung

(10) Patent No.: US 9,080,278 B2
(45) Date of Patent: Jul. 14, 2015

(54) WASHING MACHINE AND METHOD FOR MANUFACTURING THE SAME

(75) Inventor: Seung Hwan Chung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1119 days.

(21) Appl. No.: 12/801,251

(22) Filed: May 28, 2010

(65) Prior Publication Data

US 2010/0326141 A1 Dec. 30, 2010

(30) Foreign Application Priority Data

Jun. 29, 2009 (KR) ..... 10-2009-0058128

(51) Int. Cl.

| | |
|---|---|
| ***D06F 37/24*** | (2006.01) |
| ***D06F 23/04*** | (2006.01) |
| ***D06F 37/12*** | (2006.01) |

(52) U.S. Cl.

CPC ..... *D06F 37/245* (2013.01); *D06F 23/04* (2013.01); *D06F 37/12* (2013.01); *D06F 37/24* (2013.01); *D06F 2222/00* (2013.01); *Y10T 29/49904* (2015.01)

(58) Field of Classification Search

CPC ..... D06F 23/04; D06F 37/12; D06F 37/245; D06F 2222/00

USPC ..... 68/23.2, 23.3, 142; 74/572.4

See application file for complete search history.

(56) References Cited

U.S. PATENT DOCUMENTS

| | | | | | |
|---|---|---|---|---|---|
| 4,044,626 | A | * | 8/1977 | Hayashi et al. | 68/23.1 |
| 4,502,303 | A | * | 3/1985 | Wasemann | 68/23.2 |
| 5,816,074 | A | * | 10/1998 | Kim | 68/23.2 |
| 5,850,749 | A | * | 12/1998 | Kim | 68/23.2 |
| 5,855,127 | A | * | 1/1999 | Kohara et al. | 68/23.2 |
| 5,916,274 | A | * | 6/1999 | Lee et al. | 68/23.2 |
| 5,979,195 | A | * | 11/1999 | Bestell et al. | 68/23.2 |
| 6,442,782 | B1 | * | 9/2002 | Vande Haar | 8/159 |

FOREIGN PATENT DOCUMENTS

| | | |
|---|---|---|
| CN | 1095777 | 11/1994 |
| CN | 1512002 | 7/2004 |
| JP | 7-47190 | 2/1995 |
| KR | 0140939 | 3/1998 |
| KR | 1999-0031041 | 5/1999 |
| KR | 10-2007-0115287 | 12/2007 |

OTHER PUBLICATIONS

Chinese Office Action for related Chinese Patent Application No. 201010216897.3, mailed on Jan. 4, 2013.

* cited by examiner

*Primary Examiner* — Joseph L Perrin

(74) *Attorney, Agent, or Firm* — Staas & Halsey LLP

(57) ABSTRACT

A washing machine capable of preventing a balancer from being deviated from the center of a washing tub and eccentrically assembled to the washing tub, and a method of manufacturing the same is provided. For this purpose, a bending part bent corresponding to an outer circumference of the balancer may be formed at the washing tub. The balancer may include a connection rim formed at the outer circumference thereof for easier connection with the washing tub, and the bending part may enclose the connection rim.

14 Claims, 10 Drawing Sheets

WASHING MACHINE AND METHOD FOR MANUFACTURING THE SAME

CROSS-REFERENCE TO RELATED APPLICATIONS

This application claims the priority benefit of Korean Patent Application No. 2009-0058128, filed on Jun. 29, 2009 in the Korean Intellectual Property Office, the disclosure of which is incorporated herein by reference.

BACKGROUND

1. Field

Exemplary embodiments relate to a washing machine capable of preventing a balancer from being eccentrically assembled, deviated from the center of a washing tub, and a method of manufacturing the same.

2. Description of the Related Art

In general, a washing machine refers to an apparatus that removes various contaminants attached to clothes, bedclothes and so on using emulsification of detergent, friction of water currents generated by a rotating pulsator, and mechanical impact of the pulsator to the clothes. Such a washing machine detects the amount and type of laundry using a sensor, thereby setting a washing method automatically. Such a washing machine supplies wash water up to a proper water level corresponding to the detected amount and type of the laundry, and performs washing under the control of a microcomputer.

The conventional washing machine as described above includes a water tub mounted in a housing to receive a predetermined amount of water, and a washing tub to receive laundry. In addition, a pulsator is mounted in the washing tub to produce a water current. A power driving unit is mounted at a lower outer side of the water tub to transmit a driving force selectively to the washing tub or the pulsator. A balancer charged with a fluid is provided at an upper end of the water tub to balance the washing tub during rotation of the washing tub. According to the above structure, the washing machine selectively performs and controls various operational courses including washing, rinsing and spin-drying programmed by the microcomputer. Therefore, the laundry may be fully automatically washed through the operation of the pulsator and the washing tub by the power driving unit.

In the conventional washing machine, the balancer and the washing tub are interconnected by screws. During the screw-connection, however, an assembly error may occur wherein the center of the balancer is positioned eccentrically from the center of the washing tub. That is, the balancer may be connected eccentrically to the washing tub, thereby failing to perform its function of balancing the washing tub.

SUMMARY

Aspects of exemplary embodiments include a washing machine capable of preventing a balancer from being eccentrically assembled, deviated from the center of a washing tub, and a method of manufacturing the same.

In accordance with an aspect of exemplary embodiments, a washing machine includes a main body, a washing tub received in the main body, and a balancer connected to the washing tub, wherein the washing tub has a bending part bent corresponding to an outer circumference of the balancer.

The balancer may include a connection rim formed along an outer circumference thereof to facilitate connection with the washing tub, and the bending part may be formed to enclose the connection rim.

The connection rim may include an expansion part expanded in a radial direction of the balancer, and a protrusion part protruded upward from an end of the expansion part.

The bending part may include a first bending part bent toward the center of the washing tub, thereby enclosing the protrusion part, and a second bending part forming an end of the bending part.

The first bending part may be bent from an upper end of the washing tub toward the center of the washing tub, thereby enclosing the protrusion part, and the second bending part may be bent downward from the end of the first bending part.

The balancer may be connected to an upper end of the washing tub.

The bending part may be formed by a bending jig.

The balancer and the washing tub may be interconnected by a screw penetrating a lower part of the bending part and a lower part of the balancer.

The balancer may include a plastic material while the washing tub includes a metal material.

In accordance with another aspect of exemplary embodiments, a method of manufacturing a washing machine including a main body, a washing tub received in the main body, and a balancer connected to an upper part of the washing tub, wherein processes to connect the balancer with the washing tub, include preassembling the balancer to the washing tub, and bending an upper outer circumference of the washing tub.

The balancer may include a connection rim formed along an outer circumference of the balancer to facilitate connection with the washing tub, and the bending may be performed to enclose the connection rim.

The connection rim may include an expansion part expanded in a radial direction of the balancer and formed with a stepped portion at a lower part thereof, and a protrusion part protruded upward from an end of the expansion part.

The bending may be performed using a bending jig.

The balancer and the washing tub may be interconnected through a screw penetrating the washing tub and a lower part of the balancer.

BRIEF DESCRIPTION OF THE DRAWINGS

These and/or other aspects of exemplary embodiments will become apparent and more readily appreciated from the following description of exemplary embodiments, taken in conjunction with the accompanying drawings of which.

DETAILED DESCRIPTION

Figure 1:
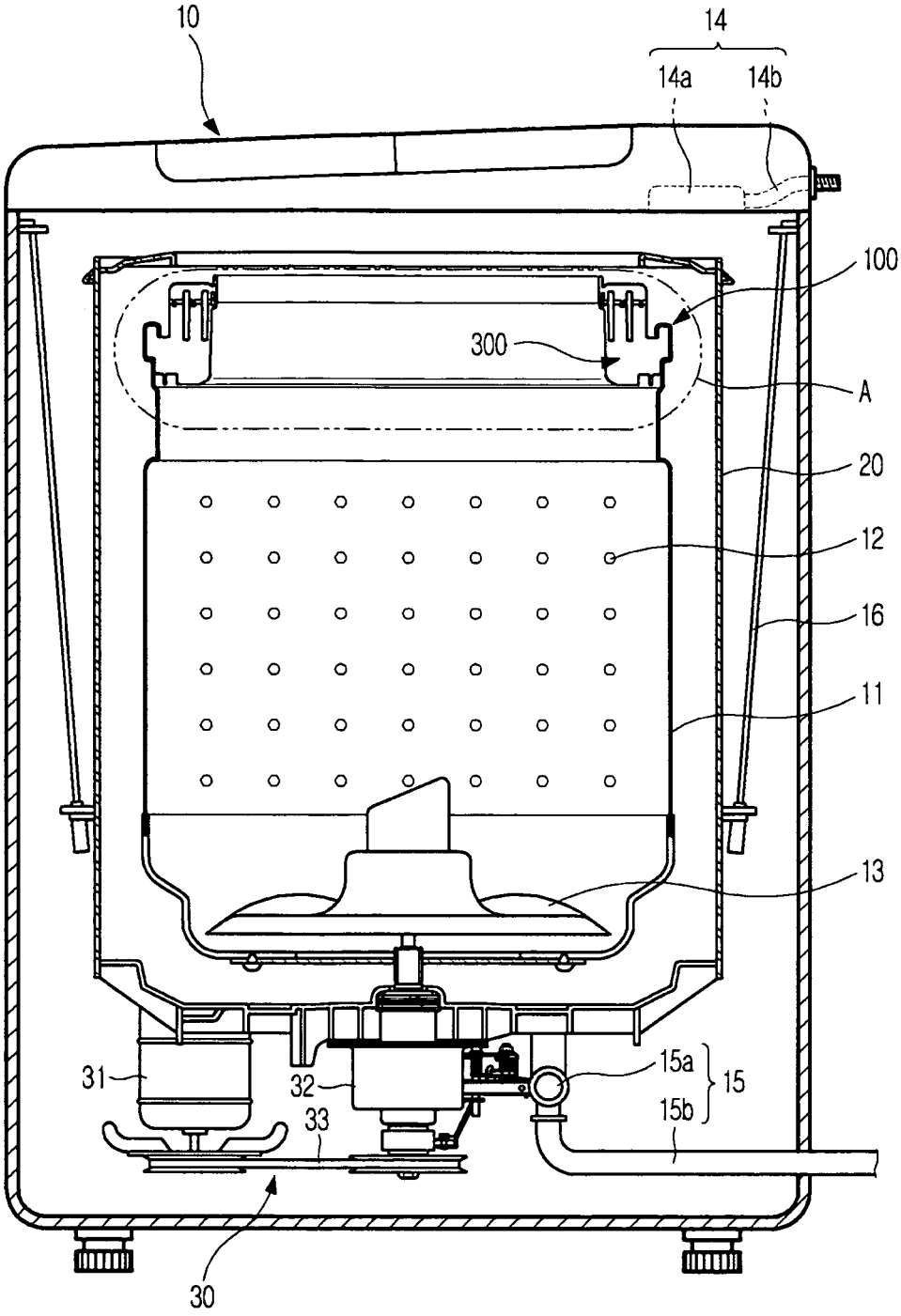
FIG. 1 is a sectional view of a washing machine according to an exemplary embodiment.

Reference will now be made in detail to exemplary embodiments, examples of which are illustrated in the accompanying drawings, wherein like reference numerals refer to like elements throughout.

Figure 2:
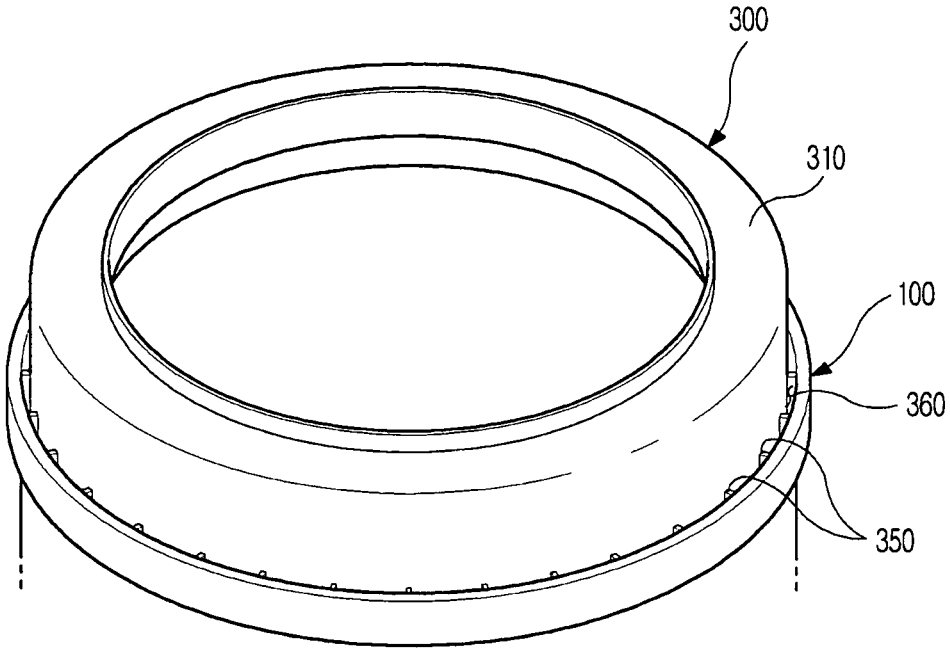
FIG. 2 is an enlarged perspective view showing a portion A of FIG. 1.
Figure 3:
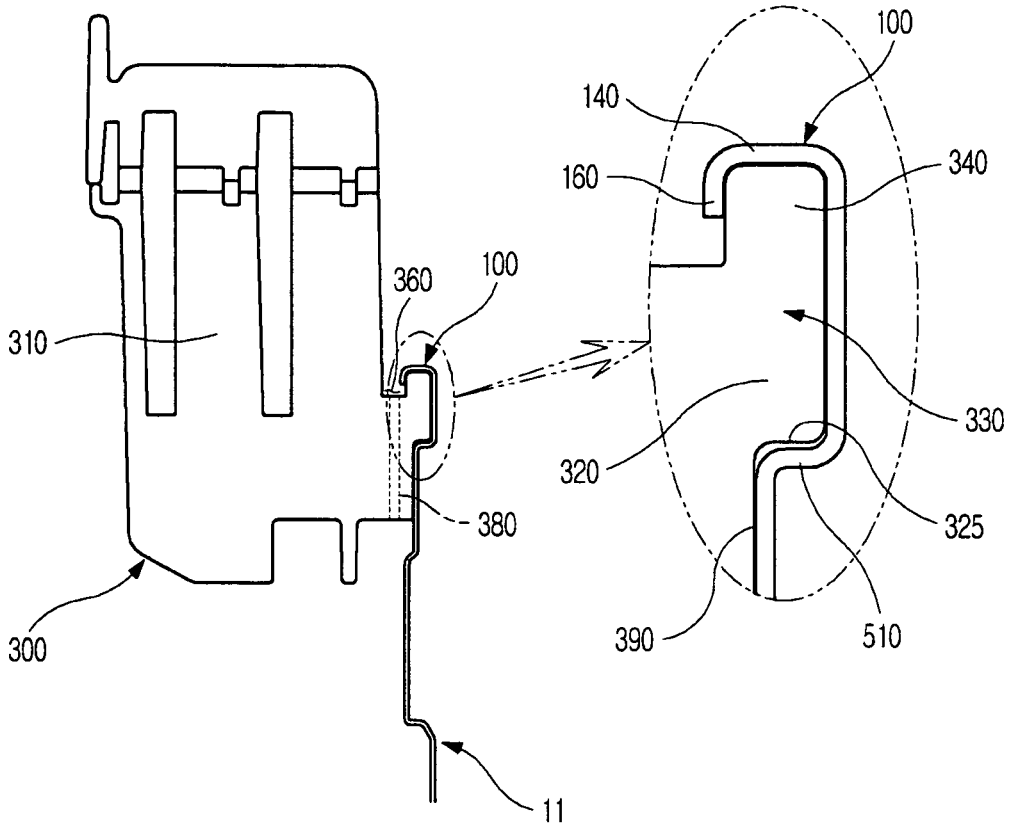
FIG. 3 is a sectional view showing the connection structure between a balancer and a washing tub.

FIG. 1 is a sectional view of a washing machine according to an exemplary embodiment, FIG. 2 is an enlarged perspective view showing a portion A of FIG. 1, and FIG. 3 is a sectional view showing the connection structure between a balancer and a washing tub.

Referring to FIG. 1, a washing machine includes a main body 10 constituting the external appearance thereof, a water tub 20 mounted in the main body 10 to receive wash water, and a washing tub 11 rotatably mounted in the water tub 20.

The washing tub 11 rotatably mounted in the water tub 20 has a cylindrical form with an open top so as to receive laundry. The washing tub 11 includes dehydration holes 12 formed on a wall thereof, and washing wings 13 generating currents of wash water by rotating forward and backward.

A balancer 300 is connected at an upper part of the washing tub 11 to balance the washing tub 11 when the washing tub 11 is rotating. The connection relations between the balancer 300 and the washing tub 11 will be described in detail later.

The water tub 20 has a cylindrical form so that the washing tub 11 is mounted within the water tub 20. A driving unit 30 is mounted at a lower outer part of the water tub 20 to rotate the washing tub 11 and the washing wings 13. The driving unit 30 may include a driving motor 31 to which electricity is applied to generate a rotational force, a power transmitter 32 transmitting the rotational force of the driving motor 31 simultaneously or selectively to the washing wings 13 and the washing tub 11, and a belt 33 interposed between the driving motor 31 and the power transmitter 32 as the medium of power transmission.

In addition, the washing machine further includes a water supply unit 14 mounted at an upper part of the water tub 14 and constituted by a water supply pipe 14*b* and a water supply valve 14*a* to supply wash water into the water tub 20, and a drainage unit 15 mounted at a lower part of the water tub 20 and constituted by a drain pipe 15*b* and a drain valve 15*a* to drain the wash water in the water tub 20 to the outside.

Additionally, a suspension unit 16 is provided to minimize transmission of vibration of the water tub 20 to the main body 10.

With the above structure, the washing machine operates as follows. Wash water containing detergent is supplied into the water tub 20, and then into the washing tub 11. After the wash water fills the washing tub 11, the washing wings 13 are repeatedly rotated forward and backward by the driving motor 31. Accordingly, the laundry and the wash water are agitated together within the washing tub 11, thus performing the washing.

After the washing operation, water supply and water drainage are repeated, during which the laundry is rinsed through the same processes as the washing operation and the wash water is drained through the drainage unit 15 after the rinsing operation. After the drainage is completed, the washing wings 13 and the washing tub 11 are rotated at a high speed by the driving motor 31, thereby spin-drying the laundry.

Referring to FIG. 2 and FIG. 3, the washing tub 11 further includes a bending part 100 at the upper part thereof. The balancer 300 is connected to the washing tub 11 through the bending part 100 disposed at the upper part of the washing tub 11.

The balancer 300 has a circular shape having a hollow opening in the center thereof. The balancer 300 includes a balancer body 310 charged with a fluid, and a connection rim 330 formed along an outer circumference of the balancer body 310 to facilitate connection with the washing tub 11. The balancer 300 may contain a plastic material.

The connection rim 330 includes an expansion part 320 expanded in a radial direction of the balancer 300, thereby forming a stepped portion 325 at a lower part of the connection rim 330, and a protrusion part 340 protruded upward from a circumferential end of the expansion part 320. The connection rim 330 serves as the medium for connection of the balancer 300 with the washing tub 11. The expansion part 320 is supported by the bending part 100 while the protrusion part 340 is fixed to the washing tub 11 by the bending part 100. Although protruded upward in this exemplary embodiment, the protrusion part 340 may be protruded upward or downward.

A connection groove 360 is formed between the connection rim 330 and the balancer body 310. A predetermined space is secured between the connection rim 330 and the balancer body 310 by the connection groove 360. Therefore, the bending part 100 may be mounted conveniently.

A plurality of strength reinforcing ribs 350 are formed at a lower part of the connection groove 360, being arranged in a circumferential direction of the balancer 300. That is, the strength reinforcing ribs 350 are formed at predetermined intervals. Since a considerable external force would be applied to the connection rim 330 connected with the bending part 100, the strength reinforcing ribs 350 are provided to supplement the strength of the connection rim 330.

In addition, drainage holes 380 are formed between respective neighboring strength reinforcing ribs 350. If the wash water in the washing tub 11 overflows, the wash water does not remain stagnant but drains to the lower part of the balancer 300 through the drainage holes 380.

The bending part 100 is bent corresponding to the outer circumference of the balancer 300. In other words, the bending part 100 is bent to enclose the connection rim 330 formed at the outer circumference of the balancer 300.

The bending part 100 includes a first bending part 140 enclosing the protrusion part 330 and a second bending part 160 forming an end of the bending part 100.

More specifically, the first bending part 140 is bent from an upper end of the washing tub 11 toward the center of the washing tub 11, thereby enclosing the protrusion part 340. The second bending part 160 is bent downward from the end of the first bending part 140.

That is, the balancer 300 is connected to the washing tub 11 not by screws as in the conventional art but by being bent at the upper circumferential end. Accordingly, the bending part 100 may function as an eccentricity prevention part that minimizes occurrence of an eccentric connection between the washing tub 11 and the balancer 300.

Hereinafter, the processes of connecting the balancer 300 to the washing tub 11 according to an exemplary embodiment.

Figure 4A:
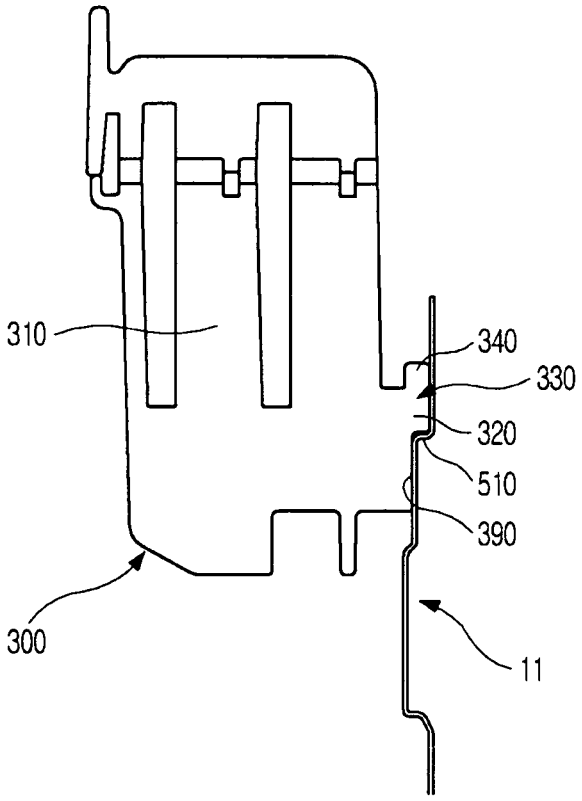
FIG. 4A to FIG. 4C are views illustrating the processes of connecting the balancer to the washing tub according to an exemplary embodiment.
Figure 4B:
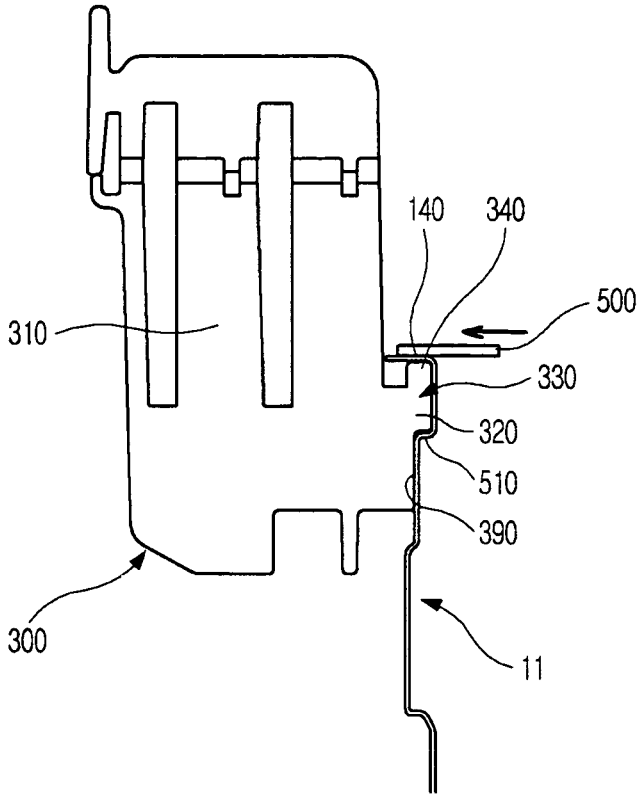
Figure 4C:
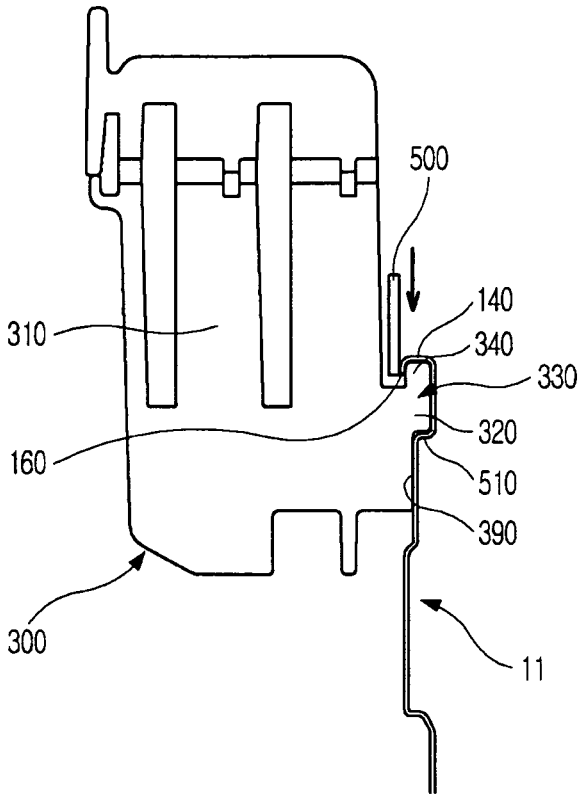
Figure 5A:
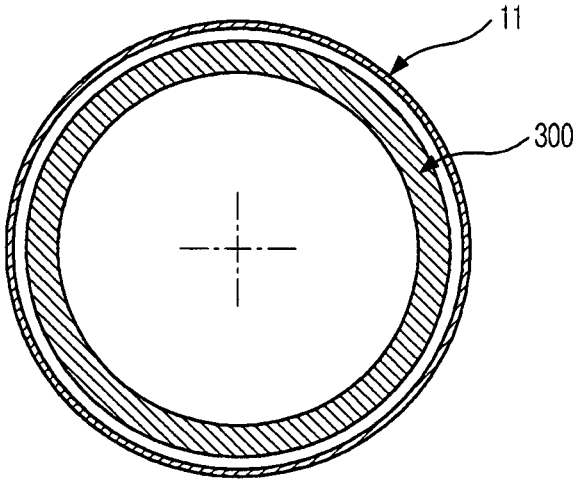
FIGS. 5A and 5B are diagrams showing the connection eccentricity of the balancer.

FIG. 4A to FIG. 4C are views illustrating the processes of connecting the balancer to the washing tub. FIG. 5A is a diagram illustrating the connection eccentricity of the balancer 300.

As shown in FIG. 4A first, the connection rim 330 of the balancer 300 is inserted in a connection part 510 formed in advance in a stepped form at the upper end of the washing tub 11. Here, the connection rim 330 and a lower part 390 of the balancer 300 are brought into close contact with an inner wall of the washing tub 11 (preassembling process).

Next, as shown in FIG. 4B, the upper end of the washing tub 11 is bent toward the center thereof using a tool such as a bending jig 500, thereby forming the first bending part 140 (first bending process). Therefore, the first bending part 140 encloses an upper part of the protrusion part 340 of the balancer 300.

Next, as shown in FIG. 4C, a leading end of the first bending part 140 is again bent downward using the bending jig 500, thereby forming the second bending part 160 (second bending process). Thus, the connection of the balancer 300 is completed.

Accordingly, the inner wall of the washing tub 11, the first bending part 140, and the second bending part 160 enclose the connection rim 330 of the balancer 300. That is, the balancer 300 is thus connected to the washing tub 11.

Figure 5B:
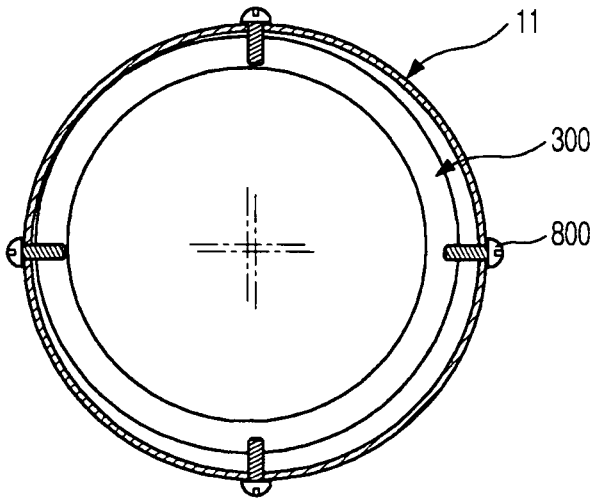

According to the above-described connection method, the balancer 300 may be connected to the washing tub 11 without causing eccentricity (deviation from the center of washing tub 11) as shown in FIG. 5A. Therefore, the eccentric connection generated at every connection position of screws 800 as shown in FIG. 5B in the conventional art, which uses the screws 800 to fasten the balancer 300 may be minimized.

Also, since the eccentric connection of the balancer 300 is prevented, the balancer 300 may function more efficiently, that is, maintaining a balance of the washing tub 11 in a rotating state.

Furthermore, manufacturing costs may be reduced by omitting the use of the screws 800.

Hereinafter, a washing machine according to another exemplary embodiment and a manufacturing method of the same will be described. Explanation of the same structures and functions as described above will be omitted.

Figure 6:
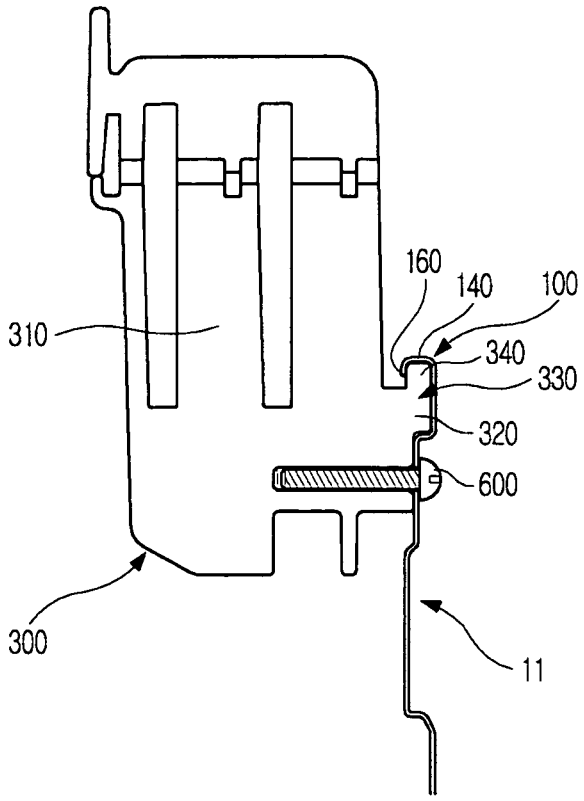
FIG. 6 is a sectional view showing the connection structure between the balancer and the washing tub in a washing machine according to another exemplary embodiment.

FIG. 6 is a sectional view showing the connection structure between the balancer and the washing tub in the washing machine according to another exemplary embodiment.

The washing machine of this exemplary embodiment further includes a screw 600 penetrating a lower part of the bending part 100 of the washing tub 11 and a lower part of the balancer 300.

Here, the screw 600 is provided to facilitate preassembling of the balancer 300 and the washing tub 11. After the screw 600 is connected to the balancer 300 and the washing tub 11, the following assembling processes are performed in the same manner as in the previous exemplary embodiment.

More specifically, after the balancer 300 is preassembled to the washing tub 11 by the screw 600, the first bending part 140 and the second bending part 160 are formed using the bending jig 500 as shown in FIG. 4B and FIG. 4C.

As the bending part 100 is formed after the preassembling of the balancer 300, an eccentric portion of the balancer 300 caused by the screw 600 is compensated for by formation of the bending part 100. Accordingly, the balancer 300 and the washing tub 11 are correctly assembled.

Hereinafter, a washing machine according to still another exemplary embodiment will be described. Explanation of the same structures and functions as in the above exemplary embodiments will be omitted.

Figure 7:
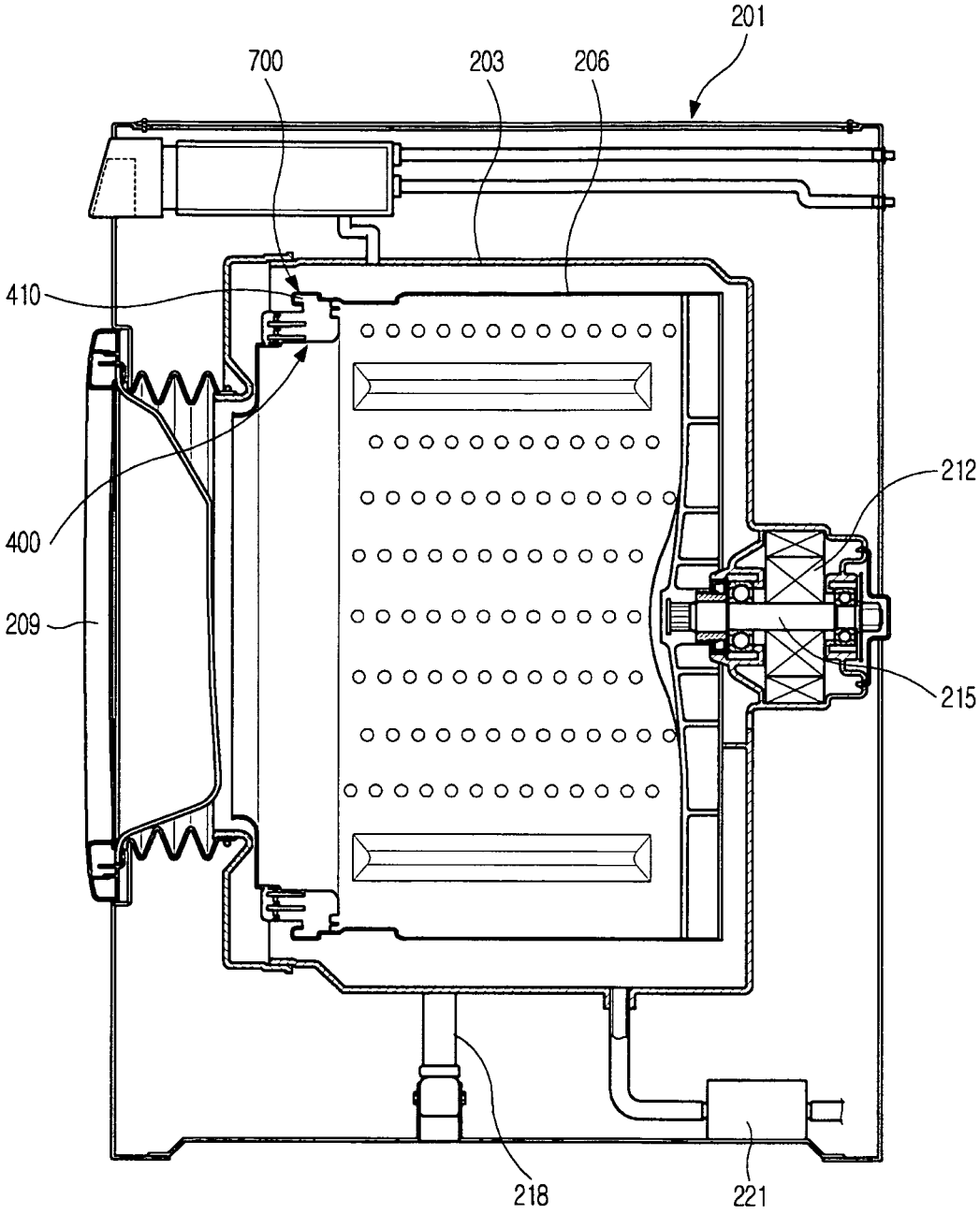
FIG. 7 is a sectional view showing the connection structure between the balancer and a rotating tub in a washing machine according to still another exemplary embodiment.

FIG. 7 is a sectional view showing the connection relations between the balancer and a rotating tub according to still another exemplary embodiment.

The washing machine of this exemplary embodiment is a drum-type washing machine including a main body 201, a fixed tub 203 mounted in the main body 201, and a rotating tub 206 mounted in the fixed tub 203. In addition, a driving motor 212 is mounted at the outside of the rotating tub 206 to rotate the rotating tub 206. The driving motor 212 and the rotating tub 206 are connected to each other by a rotational shaft 215. The washing machine further includes a damping member 218 supporting the fixed tub 203 at a lower part of the fixed tub 203, and a drainage pump 221 draining the wash water to the outside. The washing machine also includes a door 209 through which laundry is deposited into the washing machine.

The rotating tub 206 includes a bending part 700 disposed at a left end thereof with respect to the drawing. A balancer 400 is connected to the rotating tub 206 through the bending part 700 formed at the left end of the washing tub 206.

Whereas the washing tub 11 of the fully automatic washing machine is rotated about a vertical shaft, the rotating tub 206 of the drum-type washing machine is rotated about the rotational shaft 215 which is horizontally mounted. This is the reason that the balancer 400 is connected at the left end of the rotating tub 206 in an exemplary embodiment of FIG. 7.

The balancer 400 includes a connection rim 410 while the rotating tub 410 includes the bending part 700 corresponding to the connection rim 410, in the same manner as in the firstly described exemplary embodiment.

The other structures of the present exemplary embodiment are the same as in the exemplary embodiment firstly described. That is, the connection relations between the balancer 400 and the rotating tub 206 of the drum-type washing machine shown in FIG. 7 are the same as in the firstly described exemplary embodiment except for the mounting direction of the washing tub 206.

As is apparent from the above description, in accordance with a washing machine and a method of manufacturing the same according to exemplary embodiments, eccentric connection of a balancer with respect to the center of a washing tub may be prevented since the washing tub has a bending part bendable along an outer circumference of the balancer.

Moreover, manufacturing costs may be reduced since a dedicated fastening member for connecting the balancer is not necessary.

Although a few exemplary embodiments have been shown and described, it would be appreciated by those skilled in the art that changes may be made in these exemplary embodiments without departing from the principles and spirit of the present disclosure, the scope of which is defined in the claims and their equivalents.

What is claimed is:

1. A washing machine comprising:

a main body;

a washing tub received in the main body and including an inner circumferential sidewall defining an inner space to receive laundry; and a balancer connected to the washing tub, wherein the washing tub has a bending part bent corresponding to an outer circumference of the balancer, wherein the balancer comprises a connection rim, and wherein the connection rim and a lower part of the balancer are brought into close contact with the inner circumferential sidewall of the washing tub.

2. The washing machine according to claim 1, wherein:

the connection rim is formed along the outer circumference of the balancer to facilitate connection with the washing tub, and the bending part is formed to enclose the connection rim.

3. The washing machine according to claim 2, wherein the connection rim comprises:

an expansion part expanded in a radial direction of the balancer; and a protrusion part protruded upward from an end of the expansion part.

4. The washing machine according to claim 3, wherein the bending part comprises:

a first bending part bent toward the center of the washing tub, thereby enclosing the protrusion part; and a second bending part forming an end of the bending part.

5. The washing machine according to claim 4, wherein:

the first bending part is bent from an upper end of the washing tub toward the center of the washing tub, thereby enclosing the protrusion part, and the second bending part is bent downward from the end of the first bending part.

6. The washing machine according to claim 1, wherein the balancer is connected to an upper end of the washing tub.

7. The washing machine according to claim 6, wherein the balancer and the washing tub are interconnected by a screw penetrating a lower part of the bending part and a lower part of the balancer.

8. The washing machine according to claim 1, wherein the bending part is formed using a bending jig.

9. The washing machine according to claim 1, wherein the balancer comprises a plastic material and the washing tub comprises a metal material.

10. A washing machine comprising a main body, a washing tub received in the main body and including an inner circumferential sidewall defining an inner space to receive laundry, and a balancer connected to the washing tub, wherein:

the balancer comprises a balancer body and a connection rim formed along an outer circumference of the balancer and a connection groove formed between the balancer body and the connection rim, wherein the connection rim and a lower part of the balancer are brought into close contact with the inner sidewall of the washing tub, and the washing tub comprises a bending part bendable corresponding to the shape of the connection rim and the connection groove.

11. The washing machine according to claim 10, wherein the balancer further comprises a plurality of strength reinforcing ribs arranged at a lower part of the connection groove in a circumferential direction.

12. The washing machine according to claim 11, wherein the balancer comprises drainage holes each formed between the respective neighboring strength reinforcing ribs to drain wash water.

13. The washing machine according to claim 10, wherein:

the connection rim comprises an expansion part expanded in a radial direction of the balancer and formed with a stepped portion at a lower part thereof, and the protrusion part is protruded upward from an end of the expansion part.

14. The washing machine according to claim 13, wherein the bending part comprises a first bending part bent toward the center of the washing tub to enclose the protrusion part, and a second bending part forming an end of the bending part.

* * * * *